US008070380B2

(12) United States Patent
Pucillo et al.

(10) Patent No.: US 8,070,380 B2
(45) Date of Patent: Dec. 6, 2011

(54) TRAFFIC CHANNELIZER

(75) Inventors: Barry Pucillo, Glendale Heights, IL (US); Stephen S. Simovits, Jr., Downers Grove, IL (US)

(73) Assignee: Plasticade, Skokie, IL (US)

( * ) Notice: Subject to any disclaimer, the term of this patent is extended or adjusted under 35 U.S.C. 154(b) by 276 days.

(21) Appl. No.: 12/152,093

(22) Filed: May 12, 2008

(65) Prior Publication Data

US 2009/0279949 A1 Nov. 12, 2009

(51) Int. Cl.
*E01F 9/00* (2006.01)

(52) U.S. Cl. ..... 404/9; 404/10

(58) Field of Classification Search ..... 404/6, 9, 404/10; 116/69 P, 63 C, 63 P, 63 R, 63 T
See application file for complete search history.

(56) References Cited

U.S. PATENT DOCUMENTS

| | | | | | |
|---|---|---|---|---|---|
| 2,817,308 | A | | 12/1957 | Scanlon | |
| 2,942,571 | A | | 6/1960 | White | |
| 3,451,368 | A | | 6/1969 | Keats | |
| 3,499,413 | A | | 3/1970 | Heard | |
| 3,520,235 | A | | 7/1970 | Palazzolo et al. | |
| 3,732,842 | A | * | 5/1973 | Vara, Sr. | 116/63 P |
| 3,916,816 | A | | 11/1975 | Fitch | |
| 4,019,271 | A | * | 4/1977 | Latimer | 40/603 |
| D270,719 | S | * | 9/1983 | Porath et al. | D10/109 |
| D272,809 | S | * | 2/1984 | Bent et al. | D10/109 |
| 4,466,376 | A | | 8/1984 | Wells | |
| D276,510 | S | | 11/1984 | Bent et al. | |
| 4,516,109 | A | * | 5/1985 | Thurston | 340/908.1 |
| 4,573,109 | A | * | 2/1986 | Lack | 362/194 |
| 4,772,869 | A | * | 9/1988 | Grammas et al. | 116/63 C |
| 4,782,783 | A | * | 11/1988 | Kulp et al. | 116/63 P |
| D310,642 | S | | 9/1990 | Kulp | |
| 5,036,791 | A | | 8/1991 | Thurston | |
| D320,172 | S | | 9/1991 | Thurston | |
| 5,234,280 | A | * | 8/1993 | Cowan | 404/6 |
| 5,287,822 | A | * | 2/1994 | Anderson | 116/63 P |
| D386,705 | S | | 11/1997 | Morgan | |
| 5,722,788 | A | * | 3/1998 | Bent et al. | 404/6 |

(Continued)

FOREIGN PATENT DOCUMENTS

| | | |
|---|---|---|
| GB | 665785 | 1/1952 |

(Continued)

OTHER PUBLICATIONS

VIP™ Vertical Indicator Panel TD6000 Series, viewed at http://www.trafficwks.com/__download__files/TD6000%20version%2010-06-05.pdf, last viewed on Jun. 11, 2008.

(Continued)

*Primary Examiner* — Raymond Addie
(74) *Attorney, Agent, or Firm* — Brinks Hofer Gilson & Lione

(57) ABSTRACT

A traffic channelizer is provided. In one implementation, the traffic channelizer may include upper and lower portions with a center region in between. The center region may include front and back surfaces joined together by multi-faceted end regions extending and tapered from the bottom of the traffic channelizer to the top of the traffic channelizer. A handle for carrying the traffic channelizer and a bracket for mounting a warning light or other signage may be provided at the top of the traffic channelizer. The front and back surfaces may include a recessed region for mounting a reflective material or other signage.

17 Claims, 4 Drawing Sheets

U.S. PATENT DOCUMENTS

| | | | | | |
|---|---|---|---|---|---|
| 5,749,673 | A | * | 5/1998 | Kulp et al. | 404/10 |
| 5,860,237 | A | * | 1/1999 | Johnson | 40/603 |
| 5,899,167 | A | * | 5/1999 | Furman | 116/173 |
| D412,131 | S | | 7/1999 | Bent et al. | |
| D415,443 | S | | 10/1999 | Bent et al. | |
| 6,014,941 | A | * | 1/2000 | Bent et al. | 116/63 R |
| 6,182,600 | B1 | * | 2/2001 | Brown et al. | 116/63 C |
| 6,186,699 | B1 | * | 2/2001 | Kulp et al. | 404/10 |
| 6,305,312 | B1 | * | 10/2001 | Bent et al. | 116/63 P |
| 6,536,369 | B1 | * | 3/2003 | Bent et al. | 116/63 P |
| D490,334 | S | * | 5/2004 | Dvoracek | D10/109 |
| D498,161 | S | * | 11/2004 | Gagnon | D10/109 |
| D502,660 | S | * | 3/2005 | Feit et al. | D10/109 |
| D581,183 | S | * | 11/2008 | Kutscha et al. | D6/449 |
| D598,798 | S | * | 8/2009 | Tsui | D10/109 |

FOREIGN PATENT DOCUMENTS

| | | |
|---|---|---|
| GB | 1058881 | 2/1967 |
| GB | 2 122 239 A | 1/1984 |

OTHER PUBLICATIONS

Trailblazer Vertical Panel, viewed at http://www.jacksonsafety.com/linkdetails.cfm?groupid=3007676, last viewed on Jun. 11, 2008.

* cited by examiner

TRAFFIC CHANNELIZER

BACKGROUND

1. Field of Invention

The field of the invention relates to traffic channelizers.

2. Background Information

Traffic channelizers are utilized for marking lanes to direct the flow of traffic. Traffic channelizers tend to be subject to abuse because they are at risk of being hit by cars and trucks.

SUMMARY OF THE INVENTION

To address the problems identified above, a traffic channelizer is provided. In one implementation, the traffic channelizer may include upper and lower portions with a center region in between. The center region may include generally flat front and back surfaces joined together by multi-faceted end regions extending and tapered from the bottom of the traffic channelizer to the top of the traffic channelizers.

A handle for carrying the traffic channelizer and a bracket for mounting a warning light or other signage may be provided at the top of the traffic channelizer. The handle may be positioned to allow for carrying the traffic channelizer when the warning light is attached. The front and back surfaces may include recessed regions for mounting a reflective material or other signage. A stabilizing base may be provided at the bottom of the traffic channelizer to help stabilized the traffic channelizer in the presence of wind. The base may be adapted to received a rubber base attachment. The rubber base attachment may provide additional stability to the traffic channelizer.

In one implementation, the multi-faceted surfaces may be made up of a series of flat surfaces. The flat surfaces may extend from the bottom of the traffic channelizer to the top. An even number of flat surfaces may be utilized. The number of flat surfaces in each multi-faceted surface may be two or eight or any other suitable number. The multi-faceted surfaces may enable the traffic channelizer to rebound from a previously applied crushing force.

DETAILED DESCRIPTION OF THE PRESENTLY PREFERRED EMBODIMENTS

Figures 1A, 1B:
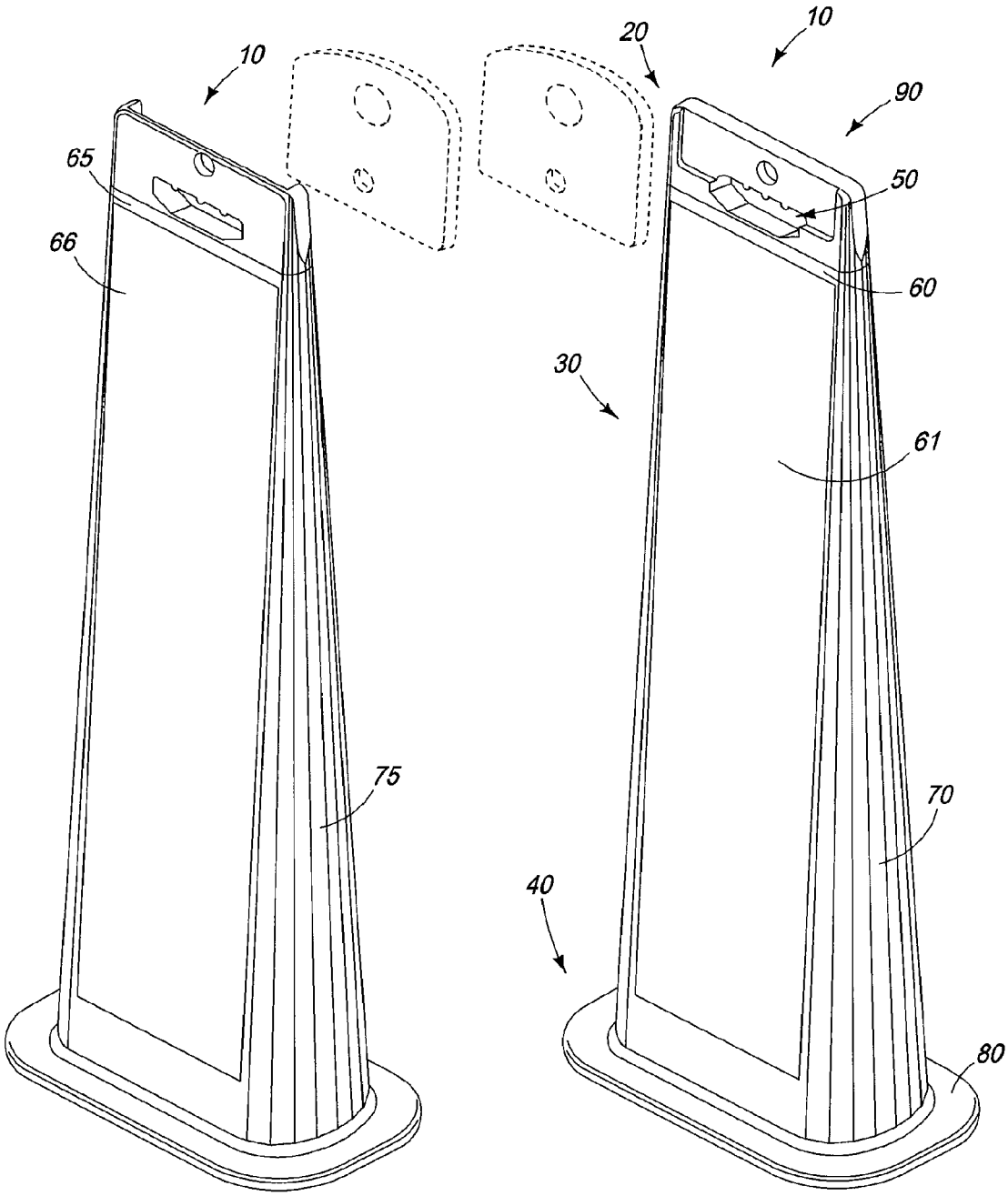
FIG. 1A shows a front perspective view of a traffic channelizer.
FIG. 1B shows a back perspective views of a traffic channelizer.

FIGS. 1A and 1B respectively show front and back perspective views of a traffic channelizer 10. Generally, the traffic channelizer 10 includes a handle 50 at a distal end 20, a center portion 30, and a base portion 80 at a proximal end 40. In a preferred embodiment, the handle 50, center portion 30 and base portion 80 are integrally formed. The center portion 30 may comprise substantially flat front and back surfaces 60 and 65 and multi-faceted end regions 70 and 75. The surfaces 70 and 75 may be tapered towards the distal end 20 of the traffic channelizer 10. Rectangularly recessed regions 61 and 66 may be provided within the front and back flat surfaces 60 and 65 to accommodate the placement of signage or reflecting sheeting (not shown).

Figure 5:
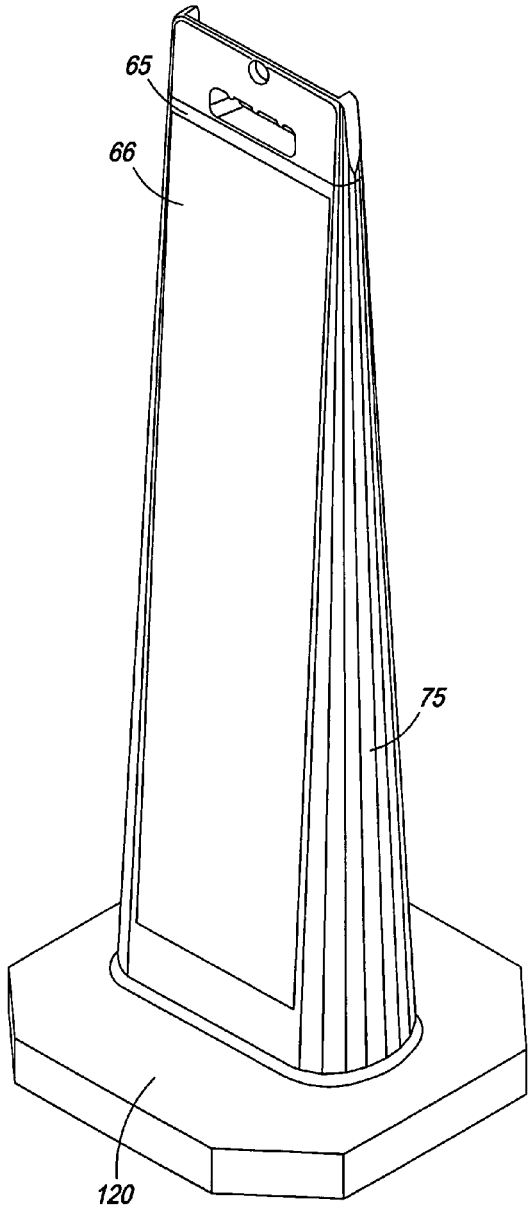
FIG. 5 illustrates a rubberized based positioned on the base portion of the traffic channelizer.

The base portion 80 at the proximal end 40 may flare away from the center of the traffic channelizer 10, as shown in FIG. 1. The base portion 80 may be utilized to provide added stability to the traffic channelizer 10. The base portion 80 may also be configured to retain a rubberized base 120, as shown in FIG. 5. The rubberized base provides additional weight at the proximal end 40 of the traffic channelizer 10, which may increase the stability of the traffic channelizer 10. The combination of the base portion 80 and rubber base may make the traffic channelizer 10 less susceptible to falling over in the presence of wind and when grazed by moving traffic.

Figure 2:
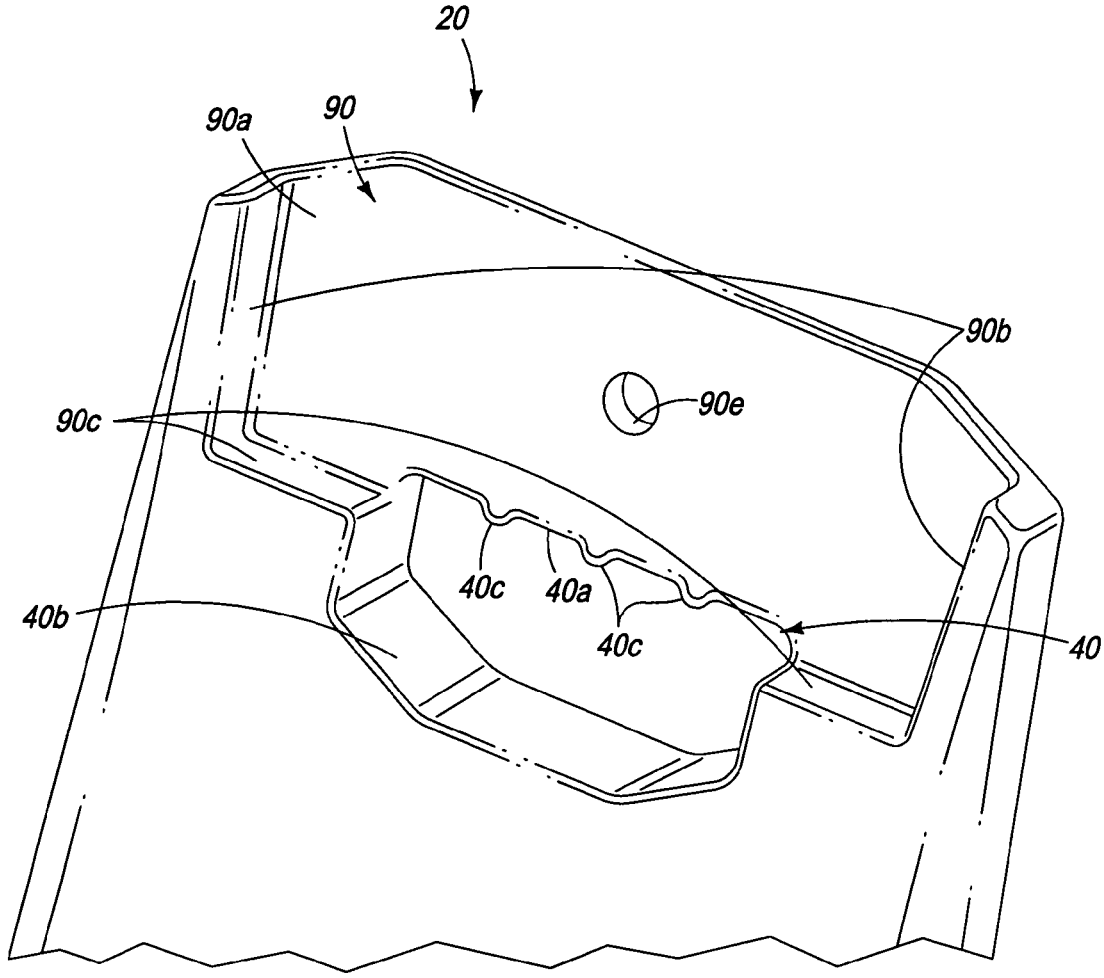
FIG. 2 is a view a mounting bracket and handle of the traffic channelizer.

As shown in FIG. 2, the distal end 20 may comprise a mounting bracket 90 and a handle 40. The mounting bracket 90 may be defined by a recessed back surface 90*a*, left and right side surfaces 90*b*, and a lower surface 90*c*. The mounting bracket 90 may be utilized to mount a warning light (not shown) or any type of signage adapted to fit within the space defined by the recessed back surface 90*a*, left and right side surfaces 90*b*, and the lower surface 90*c*. For example, a warning sign or reflector (not shown) may be mounted in the mounting bracket 90. A fastener (not shown) may be utilized to secure the warning light or signage to the signage holder portion via a fastener hole 90*e* located at a central region of the recessed back surface 90*a*. The fastener may be any fastener commonly utilized by those of skill in the art. For example, a nut and bolt or cotter pin arrangement may be utilized to secure the signage to the mounting bracket 90.

Also shown in FIG. 2 is a handle 40. Upper and lower surfaces 40*a* and 40*b* in the handle 40 may define an opening in the handle 40. The opening may be large enough to carry the traffic channelizer 10 via the handle 40. As shown, the upper surface 40*a* may be positioned substantially near the lower surface 90*c* of the mounting bracket 90. This may enable carrying the traffic channelizer 10 while an object is mounted to the mounting bracket 90. To provide a more secure grip, a series of nibs 40*c* extending from the upper surface 40*a* towards the lower surface 40*b* may be provided.

Figure 3:
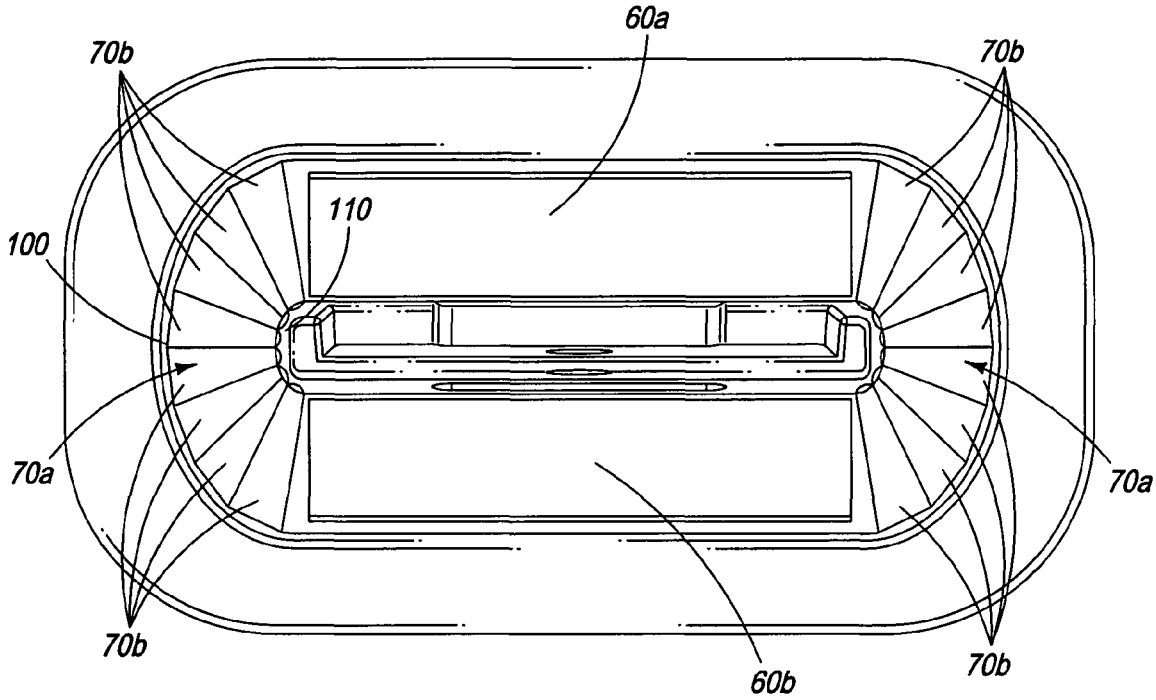
FIG. 3 is a bottom view of the traffic channelizer.
Figure 4:
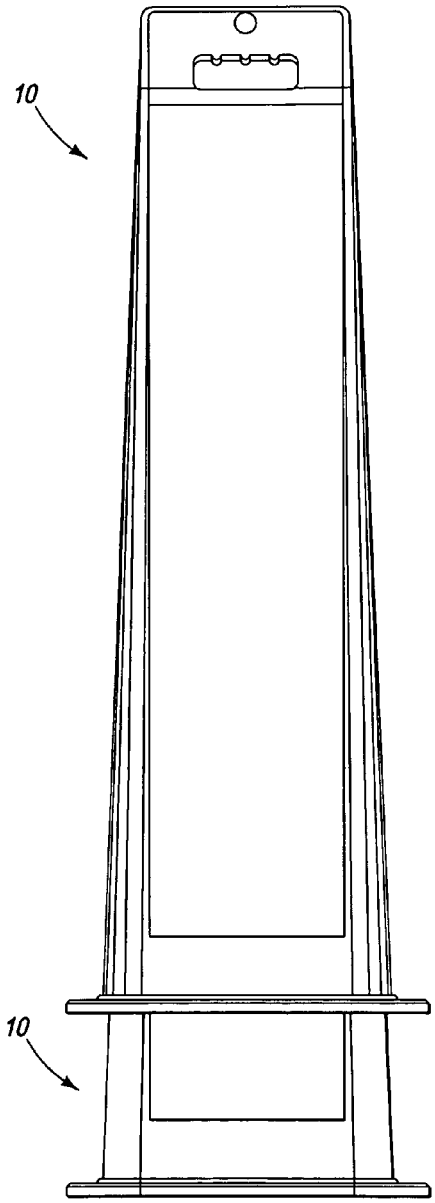
FIG. 4 illustrates stacking of the traffic channelizer.

FIG. 3 is a bottom view of the traffic channelizer 10. Generally, the inner region of the traffic channelizer 10 may be defined by front and back inner surfaces 60*a* and 60*b* and multi-faceted end regions 70*a* extending from the distal end 40 and tapering towards the proximal end 20. This may facilitate stacking the traffic channelizer 10, as shown in FIG. 4.

As shown in FIG. 3, the multi-faceted end regions 70*a* may comprise a series of generally flat surfaces 70*b* extending from a bottom edge 100 at the distal end 40 of the traffic channelizer 10 and tapering towards a top edge 110 at the proximal end 20. Preferably, the multi-faceted end regions 70*a* comprise a series of eight flat surfaces 70*b*; however, the multi-faceted end regions 70*a* may comprise as few as two flat surfaces 70*b* and may comprise more than eight flat surfaces 70*b*. Each flat surface 70*b* may be approximately 42 inches long, 0.8 inches wide at the proximal end 40, 0.2 inches wide at the distal end 20, and may taper at an angle of approximately 2 degrees.

Providing multi-faceted end regions 70*a* made up of a series of flat surfaces 70*b* may enable the traffic channelizer 10 to withstand greater impacts without being crushed. This in turn may make it less likely that the traffic channelizer 10 will be damaged beyond use, thus reducing the cost associated with replacing traffic channelizers. In the preferred embodiment, eight flat surfaces make up each multi-faceted end region 70*a*. Other embodiments with greater or fewer facets are contemplated as well.

The traffic channelizer 10 may be made from different materials and in various colors, including those most common in the traffic industry. For example, the traffic channelizer may be orange or red or any combination thereof. The traffic channelizer 10 may be formed via a blow molding, rotomolding or other processes for molding plastic or rubber into a desired shape. The traffic channelizer 10 may be made of plastic or rubber or other suitable material, such as High Density Polyethylene (HDPE) with an additive or modifier to achieve the resilience required for crashworthiness standards.

A UV stabilizer may be added to the molding material prior to molding to provide added UV protection to the traffic channelizer 10. For example, a Hindered Amine Light Stabilizer (HALS) may be added prior to molding. Other UV stabilizers or additives commonly known to those of ordinary skill may be utilized as well Any other undisclosed or incidental details of the traffic or composition of the various elements of the disclosed embodiment of the present invention or methods of their use are not believed to be critical to the achievement of the advantages of the present invention, so long as the elements possess the attributes needed for them to perform as disclosed. The selection of these and other details of traffic are believed to be well within the ability of one of even rudimentary skills in this area, in view of the present disclosure. Illustrative embodiments of the present invention have been described in considerable detail for the purpose of disclosing a practical, operative structure whereby the invention may be practiced advantageously. The designs and methods described herein are intended to be exemplary only. The novel characteristics of the invention may be incorporated in other structural forms without departing from the spirit and scope of the invention. The invention encompasses embodiments both comprising and consisting of the elements and steps described with reference to the illustrative embodiments. All technical terms shall take on their customary meaning as established by the appropriate technical discipline utilized by those normally skilled in that particular art area. It is therefore intended that the foregoing detailed description be regarded as illustrative rather than limiting. It should be understood that the following claims, including all equivalents, are intended to define the spirit and scope of this invention.

We claim:

1. A traffic channelizer comprising:

a distal that defines at a top of the traffic channelizer;

a proximal end that defines a base portion of the traffic channelizer, the base portion configured to rest on a support surface to support the traffic channelizer; and a center region there between, wherein the center region comprises front and back substantially flat surfaces joined together by a pair of multi-faceted end regions, wherein in a middle region of the center region a cross-section that passes through the front and back substantially flat surfaces and pair of multi-faceted end regions defines a substantially convex shape, wherein each end region comprises at least three substantially flat surfaces, wherein each surface of a respective end region extends continuously between the proximal end and the distal end, wherein the at least three substantially flat surfaces of the respective end regions taper towards the distal end to enable stacking of the traffic channelizer, wherein the distal end defines a mounting bracket that defines a recess configured to receive at least one of: a warning light, a reflector, and signage.

2. The traffic channelizer according to claim 1, wherein the distal end comprises a handle with nibs positioned below the mounting bracket.

3. The traffic channelizer according to claim 1, wherein at least one of the front and back surfaces comprises a recessed region for mounting signage.

4. The traffic channelizer according to claim 3, wherein the signage comprises reflective material.

5. The traffic channelizer according to claim 1, wherein the proximal end comprises a base member that flares away from the traffic channelizer.

6. The traffic channelizer according to claim 1, wherein the base member is adapted to retain a rubber base.

7. A traffic channelizer comprising:

a distal that defines at a top of the traffic channelizer;

a proximal end that defines a base portion of the traffic channelizer, the base portion configured to rest on a support surface to support the traffic channelizer; and a center region there between, wherein the center region comprises front and back substantially flat surfaces joined together by end regions, wherein each end region comprises a series of flat surfaces, wherein in a middle region of the center region a cross-section that passes through the front and back substantially flat surfaces and series of flat surfaces of the respective end regions defines a substantially convex shape, wherein each flat surface of a respective end region extends continuously between the distal end and the proximal end and, wherein each flat surface of a respective end region tapers towards the distal end to enable stacking of the traffic channelizer.

8. The traffic channelizer according to claim 7, wherein each end region comprises an even number of flat surfaces.

9. The traffic channelizer according to claim 7, wherein each end region comprises at least two flat surfaces.

10. The traffic channelizer according to claim 7, wherein each end region comprises eight flat surfaces.

11. The traffic channelizer according to claim 7, wherein the distal end comprises a bracket adapted for mounting a warning light.

12. The traffic channelizer according to claim 11, wherein the distal end comprises a handle with nibs positioned in such a way as to enable carrying the traffic channelizer via the handle when a warning light is mounted to the bracket.

13. The traffic channelizer according to claim 7, wherein the distal end comprises a bracket adapted for mounting signage.

14. The traffic channelizer according to claim 7, wherein at least one of the front and back surfaces comprises a recessed portion for mounting signage.

15. The traffic channelizer according to claim 14, wherein the signage comprises reflective material.

16. The traffic channelizer according to claim 7, wherein the proximal end comprises a base member that flares away from the traffic channelizer.

17. The traffic channelizer according to claim 16, wherein the base member is adapted to retain a rubber base attachment.

* * * * *